US008529710B2

(12) United States Patent
Ishida et al.

(10) Patent No.: US 8,529,710 B2
(45) **Date of Patent: *Sep. 10, 2013**

(54) HIGH-STRENGTH CO-BASED ALLOY WITH ENHANCED WORKABILITY AND PROCESS FOR PRODUCING THE SAME

(75) Inventors: Kiyohito Ishida, Sendai (JP); Kiyoshi Yamauchi, Sendai (JP); Ryosuke Kainuma, Natori (JP); Yuji Sutou, Sendai (JP); Toshihiro Omori, Sendai (JP)

(73) Assignee: Japan Science and Technology Agency, Kawaguchi-shi (JP)

( * ) Notice: Subject to any disclaimer, the term of this patent is extended or adjusted under 35 U.S.C. 154(b) by 744 days.

This patent is subject to a terminal disclaimer.

(21) Appl. No.: 12/098,746

(22) Filed: Apr. 7, 2008

(65) Prior Publication Data

US 2008/0185075 A1 Aug. 7, 2008

Related U.S. Application Data

(63) Continuation of application No. PCT/JP2006/320688, filed on Oct. 11, 2006.

(51) Int. Cl.
*C22C 19/07* (2006.01)

(52) U.S. Cl.
USPC ..... 148/425; 148/538; 148/408

(58) Field of Classification Search
USPC ..... 148/418, 425, 674, 538; 420/435–440
See application file for complete search history.

(56) References Cited

U.S. PATENT DOCUMENTS

| | | | | |
|---|---|---|---|---|
| 4,491,561 | A | 1/1985 | Mann | |
| 4,606,887 | A | 8/1986 | Hausselt et al. | |
| 2008/0185078 | A1* | 8/2008 | Ishida et al. | 148/674 |
| 2008/0206090 | A1* | 8/2008 | Ishida et al. | 420/461 |

FOREIGN PATENT DOCUMENTS

| | | | |
|---|---|---|---|
| JP | 59-232248 | A | 12/1984 |
| JP | 3-130322 | A | 6/1991 |
| JP | 5-25568 | A | 2/1993 |
| JP | 6-264195 | A | 9/1994 |

(Continued)

OTHER PUBLICATIONS

H. Chinen et al. New ternary compound Co3(Ge,W) with L12 structure. Scripta Materialia, vol. 56, (2007), p. 141-143.*

(Continued)

*Primary Examiner* — Jie Yang
(74) *Attorney, Agent, or Firm* — Westerman, Hattori, Daniels & Adrian, LLP

(57) ABSTRACT

A Co-based alloy being useful as a spiral spring, common spring, wire, cable guide, steel belt, build-up material, guide wire, stent, catheter, etc. There is provided a Co-based alloy having a composition of Co—Al binary system containing 3-13% Al loaded with at least one workability enhancing element selected from among 001 to 50% Ni, 0.01 to 40% Fe and 0.01 to 30% Mn and having a lamellar structure wherein f.c.c. structure α-phase and β(B2)-phase are repeated in layers. The lamellar structure is so regulated that the occupancy ratio of the whole structure is 30 vol. % or above and the layer spacing is 100 μm or less. The Co-based alloy may contain at least one optional component selected from among Ga, Cr, V, Ti, Mo, Nb, Zr, W, Ta, Hf, Si, Rh, Pd, Ir, Pt, Au, B, C and P may be added in a total amount of 0.01 to 60%.

4 Claims, 3 Drawing Sheets

(56) References Cited

FOREIGN PATENT DOCUMENTS

| | | | | |
|---|---|---|---|---|
| JP | 7-110592 | A | | 4/1995 |
| JP | 7-331370 | A | | 12/1995 |
| JP | 10-140279 | A | | 5/1998 |
| JP | 2002-129273 | A | | 5/2002 |
| JP | 2004-238720 | A | * | 8/2004 |

OTHER PUBLICATIONS

D.H. Ping et al. Microstructure of a newly developed γ' strengthened Co-base superalloy. Ultramicroscopy. vol. 107, (2007), p. 791-795.*

J. Sato et al. Cobalt-base high-temperature alloys, Science, vol. 312, (2006), p. 90-93.*

A. Suzuki et al. Flow stress anomalies in γ/γ' two-phase Co—Al—W base alloys, Scripta Materialia, vol. 56, (2007), p. 385-388.*

Q. Yao et al. Structural stability and elastic property of the L12 ordered Co3(Al,W) precipitate, Applied Physics Letters, vol. 89, (2006), p. 161906-(1-3).*

C. Jiang. First principles study of Co3(Al,W) alloys using special quasi-random structures. Scripta Materialia, vol. 59, (2008), p. 1075-1078.*

International Search Report of PCT/JP2006/320688, date of mailing Nov. 21, 2006.

* cited by examiner

Fig. 1 Co-Al bianry phase diagram
β-phase
α-phase
Magnetic transformation
ε-phase
Temperature (°C)
1600
1400
1200
1000
800
600
400
200
0
Co
10
20
30
Al (% by mass)

Lamellar structure of Co-based alloy containing 6.9%Al

500nm

Lamellar structure of Co-based alloy containing 6.9%Al-21.6%Ni

HIGH-STRENGTH CO-BASED ALLOY WITH ENHANCED WORKABILITY AND PROCESS FOR PRODUCING THE SAME

TECHNICAL FIELD

The present invention relates to a Co-based alloy which is expected to put into high strength applications, wear resistance applications, heat resistance applications, and applications for medical instruments/industrial tools and biomaterials, and further to a high-strength Co-based alloy with enhanced workability and a process for producing thereof.

BACKGROUND ART

Cr, Ni, Fe, Mo, and C etc. are added to a Co-based alloy used as a heat-resistant material, an wear resistance material, a biomaterial, a medical instrument, or an industrial tool for the purpose of the improvement in corrosion resistance and oxidation resistance, the stabilization of α-phase, and the material strengthening. Further, the Co-based alloy is strengthened by various methods for obtaining required strength such as solid solution strengthening, precipitation strengthening, and work hardening.

The conventional strengthening methods or techniques for improving the quality of materials are based on a metallic structure in which an α-single phase or a second phase is continuously precipitated in the α-phase (Patent documents 1 and 2). However, there is a demand for application directed to thinner wire and miniaturization in addition to severe using environment and much higher strength than the Co alloy strengthened by conventional methods has been required.

The strengthening method by the lamellar structure is also used for other alloy systems and a typical example thereof is a pearlite transformation which is observed in ferrous materials. When the lamellar structure of ferrite and cementite is formed by pearlite transformation, it is highly strengthened so as to satisfy the demand characteristics as piano wires.

As a method for strengthening the quality of materials using the lamellar structure, Cu—Mn—Al—Ni alloy disclosed in Patent document 3 is introduced by the present inventors and further Co—Al binary alloy having the lamellar structure is also reported in Nonpatent document 4.

Patent document 1: JP 7(1995)-179967 A

Patent document 2: JP 10(1998)-140279 A

Patent document 3: JP 5(1993)-25568 A

Nonpatent document 4: P. Zieba, Acta mater. Vol. 46, No. 1 (1998) pp. 369-377

The Co—Al binary alloy having the lamellar structure is a diplophase structure in which a precipitated hard phase is stacked onto a soft α-phase matrix with a very small interlayer spacing in layers and the coexistence of the strength and toughness at high level can be expected. However, the Co—Al binary alloy has an extremely low ductility as compared with usual metallic materials. In the case of cold working at a high workability, cracks from precipitated phase or the boundaries between the α-phase and the precipitated phase are easily generated. As a strategy to overcome the difficulties in working and allow the alloy to be formed into a target shape by cold working such as rolling, drawing, and swaging, it is considered that the working process is divided into multiple stages and strain is removed by intermediate annealing during each process. However, multiple stages of cold working with intermediate annealing lead complication of the production process and higher production cost. Therefore, it cannot be said that it is an effective solution. There is concern that the lamellar structure is disintegrated by intermediate annealing, thereby impairing the characteristics of the lamellar structure in itself.

DISCLOSURE OF THE INVENTION

The Co—Al alloy can be expected to put into wide application, coupled with the fact that if the Co—Al binary alloy having the lamellar structure can be formed into a target shape by cold working, excellent characteristics of the lamellar structure in itself are utilized and further cobalt has an excellent corrosion resistance.

Thus, the improvement in the workability of the Co—Al alloy was investigated and examined from various viewpoints such as the addition of the third component and the improvement in heat treatment conditions and working conditions. As a result, it is found that the ductility of the Co—Al alloy is improved when Ni, Fe, and Mn etc. are added, and the generation of cracks is reduced even when the cold working is performed at a high working ratio.

The present invention has been completed on the basis of the findings. An objective of the present invention is to provide the Co-based alloy whose ductility and workability can be improved by the addition of Ni, Fe, and Mn and which can be formed into various shapes without losing the characteristics of the lamellar structure and is useful as a material for various parts and members.

The Co-based alloy of the present invention has a basic component system which contains 3 to 13% by mass of Al and further comprises 0.01 to 60% by mass of workability enhancing element, and further comprises one or more of workability enhancing elements selected from 0.01 to 50% by mass of Ni, 0.01 to 40% by mass of Fe, 0.01 to 30% by mass of Mn in a total of 0.01 to 60% by mass. Further, the Co-based alloy has a lamellar structure in which the f.c.c. structure α-phase and β(B2)-phase with a smaller interlayer spacing are superimposed on each other. Since the workability is improved by the addition of Ni, Fe, and/or Mn, the alloy can be formed into a thinner shape or a thinner wire shape and has an excellent strength and wear resistance derived from the lamellar structure after the working.

Hereinafter, the content of an alloy component is simply expressed as % and other rates are expressed as % by volume and % by area.

The lamellar structure is formed by controlled cooling during the solidification process or aging treatment after solution treatment. The component system is a diplophase structure in which the f.c.c. structure α-phase and β(B2)-phase with an interlayer spacing of 100 μm or less are repeatedly superimposed and the proportion of the diplophase structure is adjusted to 30% by volume or more of the total metallic structure. Since the workability is improved by the addition of Ni, Fe, and Mn, the Co-based alloy having the lamellar structure can be subjected to 10% or more of cold working.

The Co-based alloy of the present invention has a fundamental composition in which workability enhancing elements such as Ni, Fe, and Mn are added to the Co—Al binary system and may contain other elements as optional components. One or more components selected from Table 1 may be used as the optional components. One or more optional components are added in the range of 0.001 to 60% in total. Elements capable of enhancing workability as well as the relation between an optional component and a main precipitate are shown in Table 1.

TABLE 1

Elements capable of enhancing workability, Additive amount depending on the type of optional components and Main precipitates formed

| Element name | Additive amount (%) | Main precipitates | Element name | Additive amount (%) | Main precipitates |
|---|---|---|---|---|---|
| Ni | 0.01-50 | B2 | Fe | 0.01-40 | B2 |
| Mn | 0.01-30 | B2 | Cr | 0.01-40 | B2, $M_{23}C_6$ |
| Mo | 0.01-30 | B2, $D0_{19}$ | Si | 0.01-5 | B2, C23 |
| W | 0.01-30 | B2, $L1_2$, $D0_{19}$ | Zr | 0.01-10 | B2 |
| Ta | 0.01-15 | B2 | Hf | 0.01-10 | B2 |
| Ga | 0.01-20 | B2 | V | 0.01-20 | B2, Co3V |
| Ti | 0.01-12 | B2, $L1_2$ | Nb | 0.01-20 | B2, C36 |
| C | 0.001-3 | B2, $M_{23}C_6$, $E2_1$ | Rh | 0.01-20 | B2 |
| Pd | 0.01-20 | B2 | Ir | 0.01-20 | B2 |
| Pt | 0.01-20 | B2 | Au | 0.01-10 | B2 |
| B | 0.001-1 | B2 | P | 0.001-1 | B2 |

B2: $C_sCl$ type β-phase
$D0_{19}$: $Ni_3Sn$ type
$L1_2$: $AuCu_3$ type γ' phase
$E2_1$: $CaO_3Ti$ type
C23: $Co_2Si$ type
C36: $MgNi_2$ type The lamellar structure in which the f.c.c. structure α-phase and β(B2)-phase with a smaller interlayer spacing are repeated in layers is formed by controlled cooling in solidification process or heat treatment after dissolving the Co-based alloy. In the case of the formation by controlled cooling in the solidification process, solidification and cooling is performed with an average cooling rate: 500° C./min or less in the range of 1500 to 600° C. In the case of heat treatment, solution treatment is performed at 900 to 1400° C. and then aging temperature is carried out at 500 to 900° C. The lamellar structure can be formed by combining solidification cooling and heat treatment, and further the structure can be controlled.

When the Co-based alloy having the lamellar structure formed by the controlled cooling or aging treatment is subjected to cold working such as rolling, drawing, and swaging at a working ratio of 10% or more, the lamellar structure is extended in the working direction. Thus, the formation of a fine-grained structure and the work hardening are contemplated, and further the wear resistance is improved. In addition, the workability is improved by the addition of Ni, Fe, and Mn, and thus the alloy is formed into a target shape without working defects such as cracks even when cold working is performed at a working ratio of 10% or more.

BEST MODE FOR CARRYING OUT THE INVENTION

In order to form the lamellar structure similar to a pearlite structure in steel in a Co system, it is necessary that alloy elements have a high solid solubility against Co in a high-temperature region and a low solid solubility against Co in a low temperature region so as to form a discontinuous precipitate. From the viewpoint, Al is the most suitable for the formation of the lamellar structure on the Co-based alloy. Specifically, the Co—Al binary alloy containing a proper amount of Al is subjected to controlled cooling or aging treatment and the lamellar structure in which the f.c.c. structure α-phase and β(B2)-phase with a smaller interlayer spacing are repeated.

Figure 1:
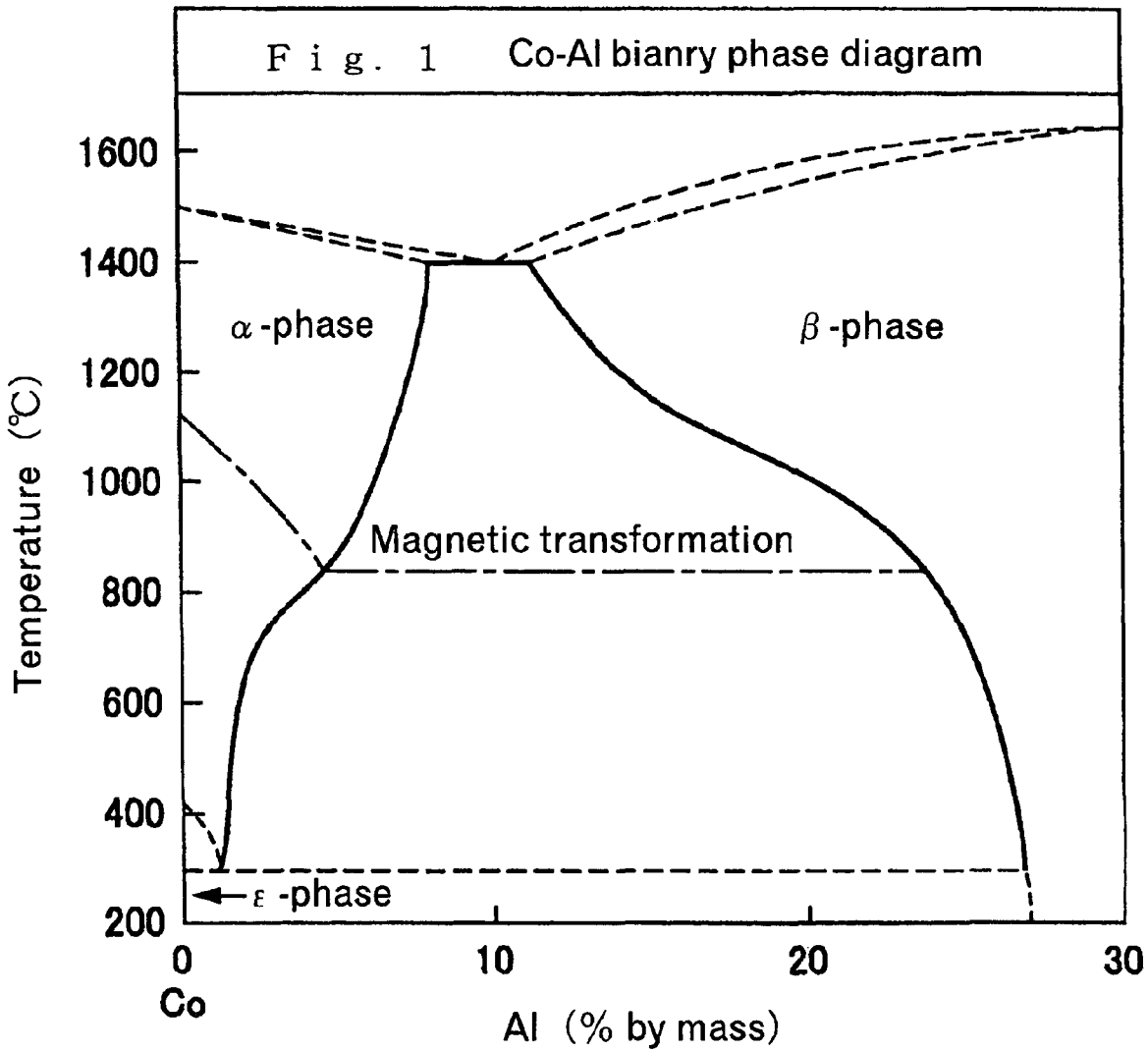
FIG. 1 is a Co—Al binary phase diagram.

The α-phase has a face-centered cubic (f.c.c.) crystal structure. As shown in the Co—Al binary phase diagram (FIG. 1), the α-phase is a phase in which Al is dissolved in Co and h.c.p. martensitic transformation in the phase may be induced at low temperature. In the Co—Al system containing Ni, Fe, and Mn, the crystallized phase or precipitated phase formed in the α-phase is the β-phase having a B2 type crystal structure. In the Co—Al system containing optional components, the $L1_2$-type γ' phase, $D0_{19}$-type precipitate, and $M_{23}C_6$-type carbide are also precipitates. These precipitates can be identified by X-ray diffraction, TEM observation, or the like. Hereinafter, the $L1_2$-type γ' phase, $D0_{19}$-type precipitate, and $M_{23}C_6$-type carbide will be represented as the β-phase if necessary.

The lamellar structure is a diplophase structure in which an α-phase and a crystallized phase or precipitated phase are repeated in layers. Better toughness is observed as an interlayer spacing (lamellar spacing) of the α-phase and the crystallized phase or precipitated phase is significantly smaller.

The lamellar structure is formed by discontinuous precipitation represented by $\alpha' \rightarrow \alpha + \beta$. Although an α'-phase is the same as the α-phase, there is a concentration gap at the interface of the α'-phase and the concentration of dissolved substance of the mother phase does not change. In the Co—Al binary system of FIG. 1, when heat treatment is performed in the α-single phase region and then in a predetermined α+β two-phase region, discontinuous precipitation occurs.

In most cases of discontinuous precipitation, the two-phase becomes a group referred to as a colony in a crystal grain boundary as a base point and grow and the lamellar structure in which the α-phase and β-phase are repeated in layers is formed.

The formation mechanism of the lamellar structure has been variously proposed.

The examples are as follows:

Precipitates which are precipitated in the grain boundary are not matched to the grain boundary and further they are matched or semi-matched to the mother phase, therefore, the grain boundary moves in the direction of an interface between the precipitate and the grain boundary based on the energy imbalance and the lamellar structure is formed by repetition of the grain boundary migration; and When the grain boundary migration occurs, precipitates are formed in the grain boundary during the process, and when further grain boundary migration occurs, they become the lamellar structure.

Various factors such as the surface energy of the mother phase and the precipitated phase, the strain energy, and differences in melting point and temperature are associated with reaction of the lamellar structure, which complicates elucidation of the formation mechanism. In any case, it is grain boundary reaction type precipitation. When premised on a general rule where the lattice diffusion where atom jumps and diffuses while occupying a crystal lattice surface area or an interstitial lattice site becomes predominant in a high temperature region and grain boundary diffusion becomes predominant in a low temperature region upon reaching about 0.75 to 0.8 Tm (Tm: absolute temperature of melting point), it can be said that a heat treatment at a relatively low temperature is necessary to form the lamellar structure resulted from the grain boundary reaction. However, when the driving force of precipitation (in other words, degree of undercooling in a single phase region) is small, the precipitation reaction becomes slow. Therefore, the degree of undercooling needs to be increased to a certain level.

The Co—Al binary condition diagram (FIG. 1) shows that the solid solubility of the α-phase is greatly reduced at the magnetic transformation temperature or less. Since the solid solubility of the α-phase is significantly changed upon reaching the magnetic transformation temperature, the difference of the solid solubility of the Co—Al binary alloy becomes great in the high and low temperature regions, which causes the increase of the driving force of precipitation. As a result, the lamellar structure can be sufficiently formed by heat treatment at low temperature.

It is known that the lamellar structure is also formed by eutectic reaction. The eutectic reaction is represented by L→α+β. In the Co—Al binary system (see FIG. 1), the eutectic reaction occurs when an alloy containing about 10% of Al is solidified. In the eutectic reaction, the α-phase and the β-phase are crystallized at the same time. Then, solute atoms are diffused throughout the solidified surface and two phases adjacent to each other grow at the same time. Thus, the lamellar structure or a bar structure is formed. The lamellar structure is formed when the volume fraction of both phases is almost equal. When there is a large difference in the volume fraction, the bar structure tends to be formed.

In the case of the Co—Al alloy containing 3 to 13% of Al, the lamellar structure is formed because there is no large difference in the volume fraction of the α-phase and the β-phase in a high temperature region in which the metallic structure is formed. In the Co—Al binary system, the α-phase is transformed to the martensitic phase of h.c.p. structure at room temperature. Generally, the h.c.p. structure tends to be inferior in workability, while the f.c.c. structure α-phase is excellent in workability. Elements capable of enhancing workability, such as Ni, Fe, and Mn etc. have an action effective in stabilizing the f.c.c. structure rather than the h.c.p. structure, and thus the workability is improved by controlling transformation of the h.c.p. structure to the martensitic phase. On the other hand, the β-phase of Co—Al based alloy tends to become softer as the ratios of Co:Ni, Co:Fe, and Co:Mn become larger. Therefore, Ni, Fe, and Mn etc. contribute to the improvement of workability, and thus the workability of the Co—Al-based alloy having the lamellar structure of the α-phase and the β-phase is improved. In addition, the formation of the lamellar structure is hardly inhibited because Ni, Fe, and Mn do not cause a great decrease in the magnetic transformation temperature.

The lamellar structure is not formed in the Co-based alloy to which the Co—Al binary alloy and workability enhancing elements, such as Ni, Fe, and Mn etc. are added, while the lamellar structure is formed in the above-described system containing an optional component by eutectoid reaction and continuous precipitation. The lamellar structure is not obtained by normal continuous precipitation, while the lamellar structure is easily formed when the intended precipitation reaction proceeds.

The Co-based alloy of the present invention has a fundamental composition of Co—Al binary system containing 3 to 13% of Al to which one or more selected from Ni, Fe, and Mn are added as workability enhancing elements. The optimal alloy design allows for cold working with a working ratio of 99.9% and significantly decreasing the number of steps of cold working which is necessary in order to obtain a target shape.

Al is a component essential for the formation of the lamellar structure in which the β(B2)-phase is crystallized or precipitated in layers and addition of 3% or more Al ensures the formation of the lamellar structure. However, when the content of Al exceeds 13%, a matrix becomes the β-phase, the proportion of the lamellar structure is significantly reduced. Preferably, the Al content is selected in the range of 4 to 10%.

Ni, Fe, and Mn are components effective in stabilizing the α-phase and contribute to the improvement of ductility. However, the addition of an excessive amount thereof has a deleterious effect on the formation of the lamellar structure. Thus, the content of Ni, Fe, and Mn is selected in the range of 0.01 to 50% (preferably 5 to 40%), in the range of 0.01 to 40% (preferably 2 to 30%), and in the range of 0.01 to 30% (preferably 2 to 20%), respectively. From the same reason, when two or three of Ni, Fe, and Mn are added at the same time, the total additive amount is selected in the range of 0.01 to 60% (preferably 2 to 40%, more preferably 5 to 25%).

Cr, Mo, and Si are components effective in improving the corrosion resistance, however, the addition of an excessive amount thereof leads to a significant deterioration in ductility. When Cr, Mo, and Si are added, the Cr content is selected in the range of 0.01 to 40% (preferably 5 to 30%), the Mo content is selected in the range of 0.01 to 30% (preferably 1 to 20%), and the Si content is selected in the range of 0.01 to 5% (preferably 1 to 3%).

W, Zr, Ta, and Hf are components effective in improving the strength, however, the addition of an excessive amount thereof leads to a significant deterioration in ductility. When W, Zr, Ta, and Hf are added, the W content is selected in the range of 0.01 to 30% (preferably 1 to 20%), the Zr content is selected in the range of 0.01 to 10% (preferably 0.1 to 2%), the Ta content is selected in the range of 0.01 to 15% (preferably 0.1 to 10%), and the Hf content is selected in the range of 0.01 to 10% (preferably 0.1 to 2%).

Although Ga, V, Ti, Nb, and C have effects to facilitate the formation of precipitates and crystallized products, the proportion of lamellar structure to total metallic structure tends to be decreased when an excessive amount of them is added. When Ga, V, Ti, Nb, and C are added, the Ga content is selected in the range of 0.01 to 20% (preferably 5 to 15%), the V content is selected in the range of 0.01 to 20% (preferably 0.1 to 15%), the Ti content is selected in the range of 0.01 to 12% (preferably 0.1 to 10%), the Nb content is selected in the range of 0.01 to 20% (preferably 0.1 to 7%), and the C content is selected in the range of 0.001 to 3% (preferably 0.05 to 2%).

Although Rh, Pd, Ir, Pt, and Au are components effective in improving X-ray contrast property, corrosion resistance, and oxidation resistance, the formation of the lamellar structure tends to be inhibited when an excessive amount of them is added. When Rh, Pd, Ir, Pt, Au are added, the Rh content is selected in the range of 0.01 to 20% (preferably 1 to 15%), the Pd content is selected in the range of 0.01 to 20% (preferably 1 to 15%), the Ir content is selected in the range of 0.01 to 20% (preferably 1 to 15%), the Pt content is selected in the range of 0.01 to 20% (preferably 1 to 15%), and the Au content is selected in the range of 0.01 to 10% (preferably 1 to 5%).

B is a component effective for grain refinement, however, an excessive content of B causes a significant deterioration in ductility. Thus, when B is added, the B content is selected from the range of 0.001 to 1% (preferably 0.005 to 0.1%).

Although P is a component effective for deoxidation, however, an excessive content of P causes a significant deterioration in ductility. When P is added, the P content is selected from the range of 0.001 to 1% (preferably 0.01 to 0.5%).

In the case where the Co-based alloy adjusted to a predetermined composition is dissolved, followed by casting and cooling, the f.c.c. structure α-phase and β(B2)-phase are crystallized while forming the lamellar structure during solidification. The lamellar spacing is proportional to $V^{-1/2}$ when the growth rate is defined as V. Therefore, the growth rate can be controlled by the growth rate V and further the lamellar spacing can be controlled. It can be said that the lamellar spacing becomes smaller as the cooling rate is faster from the viewpoint of the relation between the cooling rate and the lamellar spacing. It is preferable that solidification is performed in the range of 1500 to 600° C. (an average cooling rate: 500° C./min or less, preferably 10 to 450° C./min) to form a stable lamellar structure.

Fully satisfied characteristic can be obtained even when casting materials are used. The characteristic can be improved by performing hot working, cold working, and strain relieving annealing. The casting materials are casted and hot-rolled if necessary, and then subjected to cold working such as rolling, drawing, and swaging etc. so as to be formed into a plate member, a wire member and a pipe member etc., with a target size.

In the case of forming the lamellar structure by heat treatment, the process of the solution treatment and aging treatment is carried out.

First, the Co-based alloy after the cold working is subjected to solution treatment at 900 to 1400° C. As a result of the solution treatment, precipitates are dissolved in the matrix and the strain introduced until the cold working process is removed and the quality of materials is uniformed. It is necessary to set the solution temperature to sufficiently higher than the recrystallization temperature, and thus it is set to 1400° C. (melting point) or less at 900° C. or more. Preferably, the solution temperature is set to 1000 to 1300° C.

When the Co-based alloy after the solution treatment is subjected to aging treatment at 500 to 900° C., the lamellar structure in which the β(B2)-phase is precipitated on the α-phase matrix in layers is formed. In order to facilitate the layer precipitation, the aging temperature is set to 500° C. or more to generate a sufficient diffusion. When the heating temperature exceeds 900° C., the lattice diffusion becomes predominant and precipitates are mainly formed in crystal grains. Thus, precipitates with a different form from layer precipitates that are formed by grain boundary reaction are easily formed. For that reason, the aging temperature is selected in the range of 500 to 900° C. (preferably 550 to 750° C.). Cold working may be performed in order to facilitate the formation of the lamellar structure prior to the aging treatment. In general, when the aging temperature is lowered, the interlayer spacing becomes smaller and the volume fraction of β(B2)-phase and other precipitates is increased. The reduction of the aging time allows the interlayer spacing to be smaller.

Further, when the Co-based alloy with the lamellar structure is subjected to cold working such as rolling, drawing, and swaging etc., the lamellar structure is extended in the in the working direction. Thus, the formation of a fine-grained structure and work hardening further proceed and high strength is given. When the working ratio is 10% or more, the effect of the cold working on the improvement in strength is observed. However, an excessive working ratio makes the burdens involved in the processing plant greater. Therefore, it is preferable that the upper limit is set to about 99%.

The target shape can be obtained by cold working after the formation of the lamellar structure, which is an effect of addition of the workability enhancing elements, such as Ni, Fe, and Mn etc. The given property is important for applications of the Co-based alloy excellent in strength and wear resistance. Annealing may be carried out in the middle of working or working may be performed while annealing. The final shape may be either the shape after the working or the shape after the heat treatment. Specifically, demand characteristics vary depending on the applications and the degree of fine-graining of the lamellar structure which is required for the demand characteristics can be controlled by the workability at the time of cold working or the heat treatment conditions both prior to and subsequent to the cold working.

In either controlled cooling during casting or aging treatment, characteristics such as high strength and toughness derived from the lamellar structure are given by controlling heating conditions and setting the proportion of the lamellar structure to 30% by volume or more of the total metallic structure. Further, when the layer spacing between the f.c.c. structure α-phase and β(B2)-phase is 100 μm or less, the characteristics resulting from the lamellar structure can be effectively used.

The lamellar structure formed during the solidification process is relatively coarse, while the lamellar structure formed by the aging treatment is relatively fine-grained. Thus, when the formation of the lamellar structure by solidification is combined with the formation of the lamellar structure by aging treatment, it is also possible to form complex tissue having a coarse lamellar structure and a fine lamellar structure. However, the structure whose phase spacing is greater than 100 μm may not sufficiently exert a specific property of the lamellar structure.

The excellent characteristics are largely a result of the fine lamellar structure and it is uniformed over the entire Co-based alloy. In addition, the corrosion resistance of the Co-based alloy in itself which is more excellent than an austenitic stainless steel can be utilized. Thus, it is used as a product having a high quality and reliability, for example, a spiral spring, common spring, wire, cable guide, steel belt, bearing, build-up material and guide wire, a medical instrument such as a stent or a catheter, a dental implant, and an artificial bone since constant characteristics can be obtained even if it is miniaturized.

Subsequently, the present invention will be described with reference to Examples while referring to the drawings.

EXAMPLE 1

Co—Al binary alloys containing varying proportions of Al were dissolved and casted. In Test Nos. 7 to 9, each of the alloys formed cast structures during solidification and cooling process and left as they were. In Test Nos. 1 to 6 and 10, each alloy was cold-rolled to a plate thickness of 1 mm after hot rolling. Then, the cold-rolled plate was subjected to solution treatment at 1200° C. for 15 minutes, followed by aging heat-treatment at 600° C. for 12 hours and a lamellar structure was formed.

Figure 2:
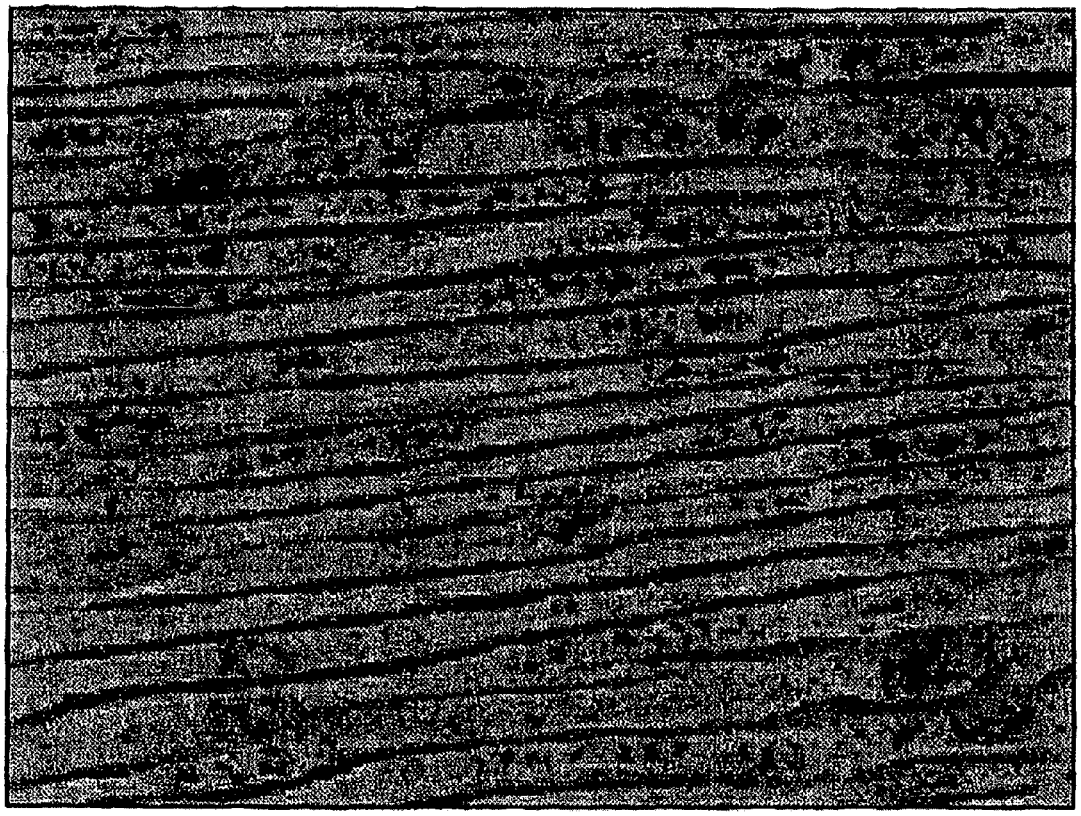
FIG. 2 is a SEM image of a lamellar structure of Sample No. 5 in Example 1.

Each Co—Al alloy plate after the aging treatment was observed with a microscope and the precipitation state of the β(B2)-phase was examined. As is apparent from the research results in Table 2, in the Co—Al alloys of Test Nos. 2 to 6 where the Al content was in the range of 3 to 13%, the β(B2)-phase was precipitated in the f.c.c. structure α-phase matrix in layers. As a result, as is apparent from FIG. 2 where the Co-based alloy of Test No. 5 was observed by SEM, a clear lamellar structure was formed.

In the Co—Al alloys of Test Nos. 7 and 8, the lamellar structure in which the f.c.c. structure α-phase and β(B2)-phase were repeated was formed because crystallization reaction was controlled by the cooling conditions during the solidification process. The interlayer spacing of Test No. 8 where the cooling rate was slow was larger than that of Test No. 7.

On the other hand, in the alloy containing less than 3% of Al of Test No. 1, the precipitation of the β(B2)-phase was insufficient and the alloy was of substantially the same structure of α-single phase. On the contrary, in the case of the Co—Al alloys containing more than 13% of excessive amounts of Al of Test No. 9 and 10, the matrix became the β(B2)-phase and the proportion of the lamellar structure was significantly reduced in either case of the controlled cooling during casting solidification process or the aging treatment.

The volume ratio converted from an area ratio of the lamellar structure and interlayer spacing which were determined in the image processing of SEM image were shown in Table 2.

TABLE 2

Al content, Effect of formation conditions on metallic structure of Co—Al binary alloy

| Test No. | Al content (%) | Conditions of formation of lamellar structure | Metallic structure: Precipitation state | Occupancy ratio of lamellar structure (vol. %) | Interlayer spacing (nm) |
|---|---|---|---|---|---|
| 1 | 1.9 | Heat treatment | No precipitation | 0 | — |
| 2 | 3.8 | Heat treatment | Layered shape | 45 | 315 |
| 3 | 4.8 | Heat treatment | Layered shape | 74 | 277 |
| 4 | 5.9 | Heat treatment | Layered shape | 98 | 248 |
| 5 | 6.9 | Heat treatment | Layered shape | 100 | 120 |
| 6 | 8.0 | Heat treatment | Layered shape + massive shape | 85 | 123 |
| 7 | 9.5 | Solidification cooling I | Layered shape | 100 | 2800 |
| 8 | 9.5 | Solidification cooling II | Layered shape | 100 | 12000 |
| 9 | 16.0 | Solidification cooling I | β-phase + massive α-phase | 0 | — |
| 10 | 16.0 | Heat treatment | β-phase spicular α-phase | 0 | — |

Heat treatment: solution treatment (at 1200° C. for 15 minutes) → aging treatment (at 600° C. for 12 hours)
Solidification cooling I: cooling with an average cooling rate: 200° C./min in the range of 1500 to 600° C.
Solidification cooling II: cooling with an average cooling rate: 50° C./min in the range of 1500 to 600° C.

Test No. 5 (formation of the lamellar structure by heat treatment) and Test No. 7 (formation of the lamellar structure by solidification cooling) in which the proportion of the lamellar structure reached 100% by volume are fundamental systems and effects of Ni, Fe, and Mn etc. on the workability enhancement were examined. The type of workability enhancing elements, additive amount, and physical properties as to the Co—Al binary alloys of Test Nos. 5 and 7 are shown in Table 3. The same tendency due to the addition of Ni, Fe, and Mn was confirmed in the Co-based alloy whose Al content was different from that of Test Nos. 5 and 7.

As is apparent from the research results in Table 3 when the Co—Al alloy in which the lamellar structure was formed over the whole visual field of the SEM image was subjected to cold working, the interlayer spacing of the lamellar structure was narrowed. As a result, the improvement in strength and wear resistance was contemplated. Although a working ratio of 10% or more is necessary to produce the effect of workability on the improvement in strength and wear resistance, it is found that a target shape can be formed without working defects such as cracks by the addition of a predetermined amount of Ni of, Fe, and Mn. This is considered that a necessary metal flow at the time of working was ensured as a result of the fact that the α-phase was softened by the addition of Ni, Fe, and Mn.

In Table 3, the strength was determined by tensile test based on JIS Z2241.

SUJ-2 was used as a mating member and the wear volume was determined by using Ogoshi wear testing machine. Specific wear volumes calculated from the measured values of wear volume were used as indicators.

The wear resistance was evaluated based on the following criteria:

◎ (Excellent): specific wear volume, $1\times10^{-6}$ $mm^2/kg$ or less;
○ (Good): specific wear volume, $(1.0\text{-}5.0)\times10^{-6}$ $mm^2/kg$;
Δ (Poor): specific wear volume, $(5.0\text{-}10)\times10^{-6}$ $mm^2/kg$; and
× (Bad): specific wear volume, $10\times10^{-6}$ $mm^2/kg$ or more.

In the cold working test, the working ratio was increased until test specimens were broken by cold rolling, drawing out, and upset forging. Then, the working ratio at the time of breakage of the specimens was determined. In any working methods, the workability was evaluated based on the following criteria:

× (Bad): Rolling reduction, reduction of area, and thickness reduction are less than 20%;
Δ (Poor) : Rolling reduction, reduction of area, and thickness reduction are 20% or more and less than 40%; and
○ (Good): Rolling reduction, reduction of area, and thickness reduction are 40% or more.

TABLE 3

Effects of Ni, Fe, and Mn on metallic structure and physical properties of Co-alloy

| Test No. | Component content (mass %): Al | Component content (mass %): Workability enhancing element | Cold working Working ratio (%) | Lamellar structure after working: Occupancy ratio (volume %) | Lamellar structure after working: Interlayer spacing (nm) | Cold working property: Rolling | Cold working property: Drawing | Cold working property: Casting | 0.2% proof strength (MPa) | Tensile strength (MPa) | Elongation (%) | Wear resistance |
|---|---|---|---|---|---|---|---|---|---|---|---|---|
| 11 | 6.9 | — | 5 | 100 | 115 | X | X | X | — | 735 | 0.6 | ◎ |
| 12 | 6.9 | Ni: 21.6 | 40 | 88 | 88 | ○ | ○ | ○ | 1025 | 1640 | 3.2 | ◎ |
| 13 | 5.9 | Fe: 10.2 | 40 | 100 | 89 | ○ | ○ | ○ | 1105 | 1557 | 2.6 | ◎ |
| 14 | 4.9 | Mn: 9.9 | 40 | 72 | 100 | ○ | ○ | ○ | 1147 | 1505 | 2.3 | ◎ |

TABLE 3-continued

Effects of Ni, Fe, and Mn on metallic structure and physical properties of Co-alloy

| Test No. | Component content (mass %) Al | Component content (mass %) Workability enhancing element | Cold working Working ratio (%) | Lamellar structure after working Occupancy ratio (volume %) | Lamellar structure after working Interlayer spacing (nm) | Cold working property Rolling | Cold working property Drawing | Cold working property Casting | 0.2% proof strength (MPa) | Tensile strength (MPa) | Elongation (%) | Wear resistance |
|---|---|---|---|---|---|---|---|---|---|---|---|---|
| 15 | 6.9 | Ni: 21.6 Mn: 5.1 | 40 | 80 | 101 | ○ | ○ | ○ | 1075 | 1586 | 4.0 | ◎ |
| 16 | 9.5 | — | 3 | 100 | 2800 | X | X | X | — | 691 | 0.5 | ○ |
| 17 | 10.3 | Ni: 18 | 25 | 95 | 1950 | ○ | ○ | ○ | 969 | 1358 | 1.9 | ○ |
| 18 | 10.3 | Fe: 10.7 | 25 | 88 | 2120 | Δ | ○ | ○ | 1070 | 1259 | 1.5 | ○ |
| 19 | 9.7 | Mn: 5.2 | 25 | 85 | 2380 | Δ | ○ | ○ | 1087 | 1150 | 1.2 | ○ |
| 20 | 10.3 | Ni: 5.6 Mn: 5.2 | 25 | 90 | 2210 | ○ | ○ | ○ | 971 | 1217 | 1.7 | ○ |

EXAMPLE 2

Taking the Co-based alloy of Test No. 12 in Example 1 where the finest lamellar structure was formed as an example, effects of temperature conditions in the solution treatment and aging treatment on the precipitation of layered β(B2)-phase were examined.

As is apparent from the research results in Table 4, the precipitation of the β(B2)-phase was facilitated in conditions of a solution treatment temperature in the range of 900 to 1400° C. and an aging temperature in the range of 500 to 900° C. As a result, the desired lamellar structure was obtained. The α-phase rich in ductility was stabilized by mixing with Ni and the β(B2)-phase was also softened, thereby significantly improving the ductility. The lamellar structure without micro cracks was observed after cold-rolling to a predetermined shape at a working ratio of 40%.

In the case where the aging temperature was less than 500° C., the formation and growth of the β(B2)-phase were insufficient and the lamellar structure was not formed. In the case where the aging temperature was greater than 900° C., the β(B2)-phase was not precipitated in layers. Further, in Test No. 21 where the solution treatment temperature did not reach, precipitates were not sufficiently dissolved and the aging treatment was carried out. As a result, the formation of lamellar structure was inhibited by a residue of the precipitates. However, in the case where the solution treatment was performed at high temperatures greater than 1400° C., a liquid phase formed by partial melting was appeared, which resulted in a structure in which a massive structure derived from the liquid phase was mixed with a layer structure.

TABLE 4

Effects of heat treatment conditions on metallic structure and physical properties of Co-alloy containing 6.9% of Al and 21.6% of Ni (Cold rolling ratio: Nos. 22 to 28; 40%, Nos. 21 and 29: 5%)

| Test No. | Solution treatment ° C. | Solution treatment min. | Aging treatment ° C. | Aging treatment hr. | Metallic structure: Precipitation state of β-phase | Metallic structure: Occupancy ratio of lamellar structure (volume %) | Metallic structure: Interlayer spacing (nm) | 0.2% proof strength (MPa) | Tensile strength (MPa) | Elongation (%) | Work limitation (%) | Wear resistance |
|---|---|---|---|---|---|---|---|---|---|---|---|---|
| 21 | 800 | 120 | 600 | 12 | Stick shape + layered shape | 12 | 220 | — | 714 | 0.3 | 25 | Δ |
| 22 | 950 | 120 | 600 | 12 | Layered shape + stick shape | 41 | 112 | 909 | 1121 | 1.9 | 42 | ◎ |
| 23 | 1200 | 15 | 400 | 48 | No precipitation | 0 | — | 268 | 886 | 33.7 | 77 | X |
| 24 | 1200 | 15 | 600 | 48 | Layered shape | 88 | 88 | 1125 | 1640 | 3.2 | 52 | ○ |
| 25 | 1200 | 15 | 700 | 12 | Layered shape | 100 | 90 | 1130 | 1655 | 2.9 | 48 | ◎ |
| 26 | 1200 | 15 | 900 | 6 | Layered shape + stick shape | 33 | 167 | 818 | 1085 | 5.5 | 53 | ○ |
| 27 | 1200 | 15 | 1000 | 12 | Stick shape | 0 | — | 756 | 873 | 7.1 | 61 | Δ |
| 28 | 1350 | 15 | 700 | 12 | Layered shape | 100 | 95 | 1108 | 1634 | 2.8 | 48 | ◎ |
| 29 | 1440 | 15 | 600 | 12 | Liquid phase + layered shape | 5 | 205 | — | 588 | 0.3 | 7 | X |

The work limitation is defined as the maximum rolling reduction where the cold rolling can be performed without generation of cracks.

Further, alloys of Test Nos. 24, 25, and 28 in which the lamellar structure was formed was left as they were after the heat treatment, which was then subjected to swaging with various degrees of working. Then, changes in the lamellar structure and physical properties caused by the working were examined.

Figure 3:
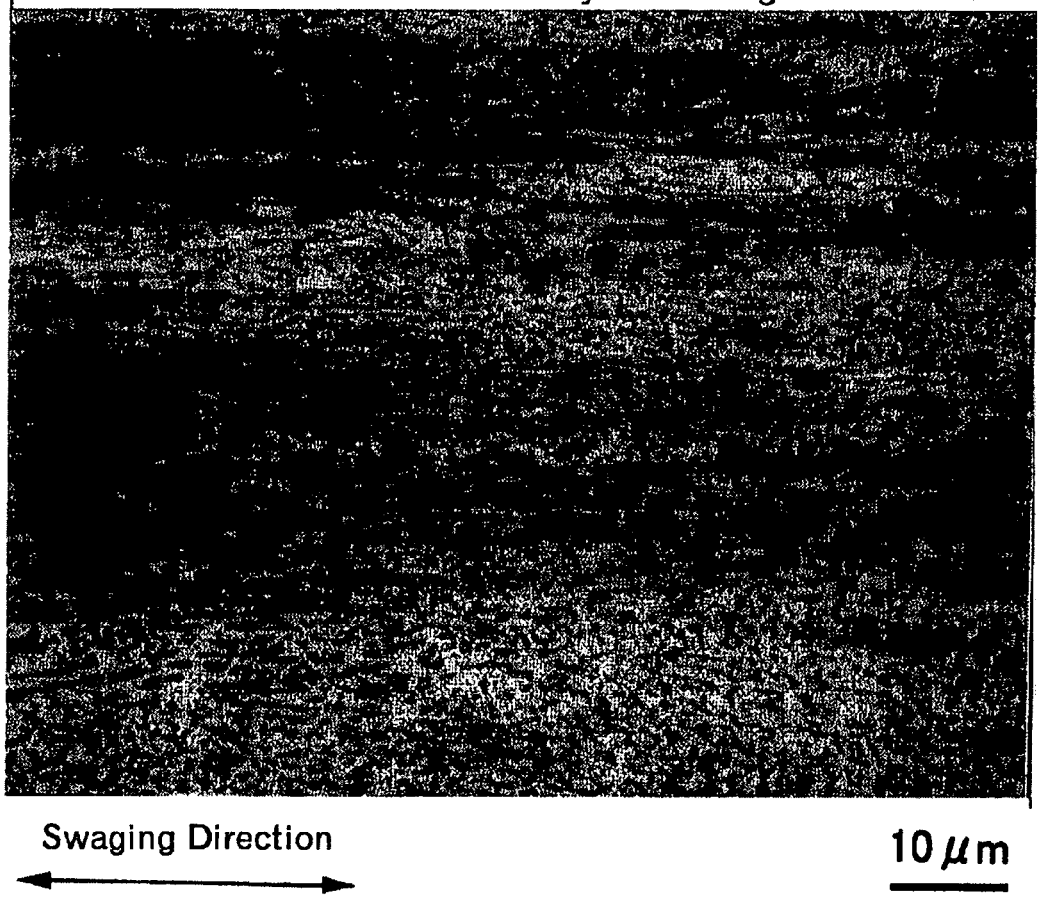
FIG. 3 is an optical microscope image showing the lamellar structure of the Co—Al—Ni alloy swaged.

As is apparent from the research results in Table 5, the lamellar structure was extended in the swaging direction and further the lamellar structure was fine-grained (FIG. 3). The fine-grained lamellar structure was also effective for the improvement in physical properties of the Co-based alloy, coupled with work hardening. Such an effect of the cold working was observed when the reduction of area was 10% or more. The effect was more significant as the reduction of area was higher.

TABLE 5

Effects of swaging on metallic structure and physical properties of Co-alloy containing 6.9% of Al and 21.6% of Ni

| Test No. | Reduction rate of area in swaging process (%) | Lamellar structure: Occupancy ratio (vol. %) | Lamellar structure: Interlayer spacing (nm) | 0.2% proof strength (MPa) | Tensile strength (MPa) | Elongation (%) | Wear resistance |
|---|---|---|---|---|---|---|---|
| 14 | 10 | 88 | 112 | 625 | 1005 | 7.9 | ○ |
| | 19 | 88 | 94 | 744 | 1085 | 6.2 | ◎ |
| | 44 | 88 | 80 | 1151 | 1658 | 4.1 | ◎ |
| | 75 | 88 | 63 | 1238 | 1757 | 3.0 | ◎ |
| 15 | 10 | 100 | 114 | 655 | 1058 | 7.3 | ◎ |
| | 19 | 100 | 96 | 795 | 1108 | 6.0 | ◎ |
| | 44 | 100 | 83 | 1153 | 1681 | 4.0 | ◎ |
| | 75 | 100 | 67 | 1265 | 1780 | 2.9 | ◎ |
| 18 | 10 | 100 | 118 | 642 | 1049 | 7.0 | ◎ |
| | 19 | 100 | 100 | 783 | 1098 | 5.7 | ◎ |
| | 44 | 100 | 88 | 1118 | 1641 | 3.7 | ◎ |
| | 75 | 100 | 72 | 1260 | 1761 | 2.8 | ◎ |

EXAMPLE 3

Optional component is added to Co—6.9% Al—21.6% Ni alloy, effects of the optional components on the lamellar structure and the mechanical property were examined. In the corrosion test, the passive current density at 0 V vs. SCE was determined by the anode polarization test using PBS (−) solution at 25° C. The corrosion resistance was evaluated based on the following criteria:

◎ (Excellent): passive current density, 0.05 A/m$^2$ or less;
○ (Good): passive current density, 0.05 to 0.1 A/m$^2$;
Δ (Poor): passive current density, 0.1 to 0.3 A/m$^2$; and
× (Bad): passive current density, 0.3 A/m$^2$ or more.

Further, the workability was examined by the same standard as that of Example 1.

As is apparent from the research results in Table 6, the lamellar structure is preserved and the corrosion resistance, strength, and elongation were enhanced by the addition of the optional components. Thus, it could be formed into a target shape without working defects such as cracks even when cold working was performed at a working ratio of greater than 10%.

TABLE 6

Effects of the addition of third component on lamellar structure and physical properties (Solution treatment: at 1200 C. ° for 15 min: aging treatment: at 600 C. ° for 24 hr)

| Test No. | Alloy composition (%, balance being cobalt): Al | Workability enhancing element | Optional component | Lamellar structure: Form of precipitation | Occupancy ratio (volume %) | Interlayer spacing (nm) | 0.2% proof strength (MPa) | Tensile strength (MPa) | Elongation (%) | Corrosion resistance | Workability: Rolling | Drawing | Casting |
|---|---|---|---|---|---|---|---|---|---|---|---|---|---|
| 30 | 6.0 | Ni: 19.7 | Cr: 19.4 | Layered shape | 65 | 349 | 581 | 987 | 11.5 | ◎ | ○ | ○ | ○ |
| 31 | 5.0 | Fe: 10.3 | Cr: 19.2 | Layered shape | 100 | 136 | 1190 | 1211 | 1.0 | ◎ | ○ | ○ | ○ |
| 32 | 4.7 | Ni: 20.5 | Mo: 8.4<br>C: 0.1 | Layered shape + plated shape | 49 | 181 | 1310 | 1387 | 1.0 | ○ | Δ | ○ | ○ |

TABLE 6-continued

Effects of the addition of third component on lamellar structure and physical properties
(Solution treatment: at 1200 C. ° for 15 min: aging treatment: at 600 C. ° for 24 hr)

| | Alloy composition (%, balance being cobalt) | | | Lamellar structure | | | | | | Workability | | |
|---|---|---|---|---|---|---|---|---|---|---|---|---|
| Test No. | Al | Workability enhancing element | Optional component | Form of precipitation | Occupancy ratio (volume %) | Interlayer spacing (nm) | 0.2% proof strength (MPa) | Tensile strength (MPa) | Elongation (%) | Corrosion resistance | Rolling | Drawing | Casting |
| 33 | 7.2 | Fe: 10.6 | C: 0.7 | Layered shape + plated shape | 44 | 180 | 948 | 1042 | 1.7 | ○ | Δ | Δ | ○ |
| 34 | 7.0 | Ni: 21.6 | B: 0.04 | Layered shape | 100 | 268 | 622 | 965 | 13.3 | ○ | ○ | ○ | ○ |
| 35 | 4.0 | Mn: 4.0 | W: 27.0 | Layered shape + plated shape | 65 | 155 | 1114 | 1186 | 1.0 | ○ | Δ | Δ | ○ |
| 36 | 4.6 | Mn: 4.6 | Mo: 16.2 | Layered shape + plated shape | 71 | 180 | 1130 | 1196 | 1.0 | ○ | Δ | Δ | ○ |
| 37 | 4.7 | Ni: 10.1 Fe: 4.8 | Ta: 6.2 | Layered shape | 46 | 338 | 689 | 752 | 5.6 | ○ | Δ | Δ | Δ |
| 38 | 4.9 | Ni: 10.7 Mn: 5.0 | Ti: 7.0 | Layered shape + plated shape | 60 | 258 | 683 | 871 | 8.0 | ○ | ○ | ○ | ○ |
| 39 | 5.8 | Fe: 5.0 Mn: 5.0 | Ir: 1.7 | Layered shape | 78 | 220 | 752 | 1041 | 3.8 | ○ | ○ | ○ | ○ |
| 40 | 5.9 | Ni: 5.3 Fe: 2.0 Mn: 2.0 | P: 0.01 | Layered shape | 84 | 251 | 630 | 851 | 10.3 | ○ | ○ | ○ | ○ |

Industrial Applicability

As described above, the Co-based alloy in which Ni, Fe, and Mn are added to the Co—Al binary system containing 3 to 13% of Al as the workability enhancing element has the lamellar structure formed by controlled cooling after the casting or by aging treatment after the solution treatment. Therefore, the Co-based alloy is a material that exhibits a sufficient strength even if it forms a thinner wire structure or a fine-grained structure. In addition, the workability is enhanced, and thus it can be formed into a predetermined shape without working defect even when cold working such as rolling, drawing out, or swaging is performed. Thus, the Co—Al binary alloy can be formed into the target shape required for various applications without impairing characteristics of the Co—Al binary alloy resulting from a fine lamellar structure. Further, it is used in wide fields such as spiral springs, common springs, wires, cable guides, steel belts, bearings, build-up materials, guide wires, stents, catheters, artificial bones, and dental implants.

The invention claimed is:

1. A high-strength Co-based alloy produced by the steps of:

dissolving a Co-based alloy having a composition that comprises, on the basis of mass percent, 3 to 13% of Al, and 0.01 to 60% of one or more workability enhancing elements selected from the group consisting of 0.01 to 50% of Ni, 0.01 to 40% of Fe and 0.01 to 30% of Mn;

solidifying with an average cooling rate of 50 to 200 ° C/min in the range of 1500 to 600 ° C.; and performing cold working at a working ratio of 10% or more;

wherein the high-strength Co-based alloy has a metallic structure having a lamellar structure wherein a f.c.c. structure a-phase and β(B2)-phase with an interlayer spacing of 100 μm or less are repeated in layers and the occupancy ratio is 30% by volume or more.

2. A high-strength Co-based alloy produced by the steps of:

performing solution treatment at 1100 to 1300° C. on a Co-based alloy having a composition that comprises, on the basis of mass percent, 3 to 13% of Al, and 01 to 60% of one or more workability enhancing elements selected from the group consisting of 0.01 to 50% of Ni, 0.01 to 40% of Fe and 0.01 to 30% of Mn;

performing aging treatment at 550 to 750° C.; and performing cold working at a working ratio of 10% or more;

wherein the high-strength Co-based alloy has a metallic structure having a lamellar structure wherein a f.c.c. structure a-phase and β(B2)-type phase with an interlayer spacing of 100 μm or less are repeated in layers and the occupancy ratio of the lamellar structure to the whole metallic structure is 30% by volume or more.

3. A high strength Co-based alloy produced by the steps of:

dissolving a Co-based alloy having a composition that comprises, on the basis of mass percent, 3 to 13% of Al, 0.01 to 60% of one more workability enhancing elements selected from the group consisting of 0.01 to 50% of Ni, 0.01 to 40% of Fe and 0.01 to 30% of Mn, and 0.001% or more in total of at least one element selected from the group consisting of 0.01 to 40% of Cr, 0.01 to 30% of Mo, 0.01 to 5% of Si, 0.01 to 30% of W, 0.01 to 10% of Zr, 0.01 to 15% of Ta, 0.01 to 10% of Hf, 0.01 to 20% of Ga, 0.01 to 20% of V, 0.01 to 12% of Ti, 0.01 to 20% of Nb, 0.001 to 3% of C, 0.01 to 20% of Rh, 0.01 to 20% of Pd, 0.01 to 20% of Ir, 0.01 to 20% of Pt, 0.01 to 10% of Au, 0.001 to 1% of B, and 0.001 to 1% of P in a total of 0.001 to 60%;

solidifying with an average cooling rate of 50 to 200° C/min in the range of 1500 to 600 ° C.; and performing cold working at a working ratio of 10% of more;

wherein the high-strength Co-based alloy has a lamellar structure wherein a f.c.c. structure α-phase and β(B2)-type phase, a $L1_2$-type γ' phase, a $D0_{19}$-type precipitate, and/or a $M_{23}C_6$-type carbide with an interlayer spacing of 100 μm or less are repeated in layers and the occupancy ratio of the lamellar structure to the whole metallic structure is 30% by volume or more.

4. A high strength Co-based alloy produced by the steps of:

performing solution treatment at 1100 to 1300° C. on a Co-based alloy having a composition that comprises, on the basis of mass percent, 3 to 13% of Al, 0.01 to 60% of one more workability enhancing elements selected from the group consisting of 0.01 to 50% of Ni, 0.01 to 40% of Fe and 0.01 to 30% of Mn, and 0.001% or more in total of at least one element selected from the group consisting of 0.01 to 40% of Cr, 0.01 to 30% of Mo, 0.01 to 5% of Si, 0.01 to 30% of W, 0.01 to 10% of Zr, 0.01 to 15% of Ta, 0.01 to 10% of Hf, 0.01 to 20% of Ga, 0.01 to 20% of V, 0.01 to 12% of Ti, 0.01 to 20% of Nb, 0.001 to 3% of C, 0.01 to 20% of Rh, 0.01 to 20% of Pd, 0.01 to 20% of Ir, 0.01 to 20% of Pt, 0.01 to 10% of Au, 0.001 to 1% of B, and 0.001 to 1% of P in a total of 0.001 to 60%;

solidifying with an average cooling rate of 50 to 200° C/min in the range of 1500 to 600° C.;

performing aging treatment at 550 to 750° C.; and performing cold working at a working ratio of 10% of more;

wherein the high-strength Co-based alloy has a lamellar structure wherein a f.c.c. structure α-phase and β(B2)-type phase, a $L1_2$-type γ' phase, a $D0_{19}$-type precipitate, and/or a $M_{23}C_6$-type carbide with an interlayer spacing of 100μm or less are repeated in layers and the occupancy ratio of the lamellar structure to the whole metallic structure is 30% by volume or more.

* * * * *